United States Patent [19]

Kelley

[11] 4,215,474

[45] Aug. 5, 1980

[54] HAIR SHEARS

[76] Inventor: Thomas G. Kelley, 3645 E. 147th St., Cleveland, Ohio 44128

[21] Appl. No.: 955,933

[22] Filed: Oct. 30, 1978

[51] Int. Cl.[2] ..... B26B 13/22

[52] U.S. Cl. ..... 30/233

[58] Field of Search ..... 30/233, 233.5, 123, 30/200; 7/164

[56] References Cited

U.S. PATENT DOCUMENTS

| | | | |
|---|---|---|---|
| 3,540,122 | 11/1970 | Bogdan | 30/123 R |
| 3,816,864 | 6/1974 | Cotter | 7/164 |
| 3,885,306 | 5/1975 | Herman | 30/123 |

*Primary Examiner*—Jimmy C. Peters

*Attorney, Agent, or Firm*—Baldwin, Egan, Walling & Fetzer

[57] ABSTRACT

Shears for cutting or trimming hair are presented equipped with a device for indicating, to the hair-trimming stylist, the general angle relative to the horizontal at which the cut is being made. The indicating device disclosed is a spirit level with the usual single small bubble inside the level and, preferably with a plurality of marks spaced longitudinally of the level so that the angle is at least roughly indicated to the hair stylist.

3 Claims, 4 Drawing Figures

HAIR SHEARS

An object of the present invention is to provide hair-trimming shears with means to indicate the angle at which a cut is being made, so as to insure the desired appearance in the finished job.

Another object of the invention is to add to hair-trimming shears a plurality of spirit level devices, easily read by the hair stylist, to inform him of the angle of the cut he is making relative to the horizontal.

Other objects and advantages of the present invention will be apparent from the attached specification and drawings, and the essential features thereof will be set forth in the appended claims.

In the drawings:

FIG. 3 is an enlarged sectional view of one of the spirit levels taken along the line 3—3 of FIG. 1; while

Figure 1:
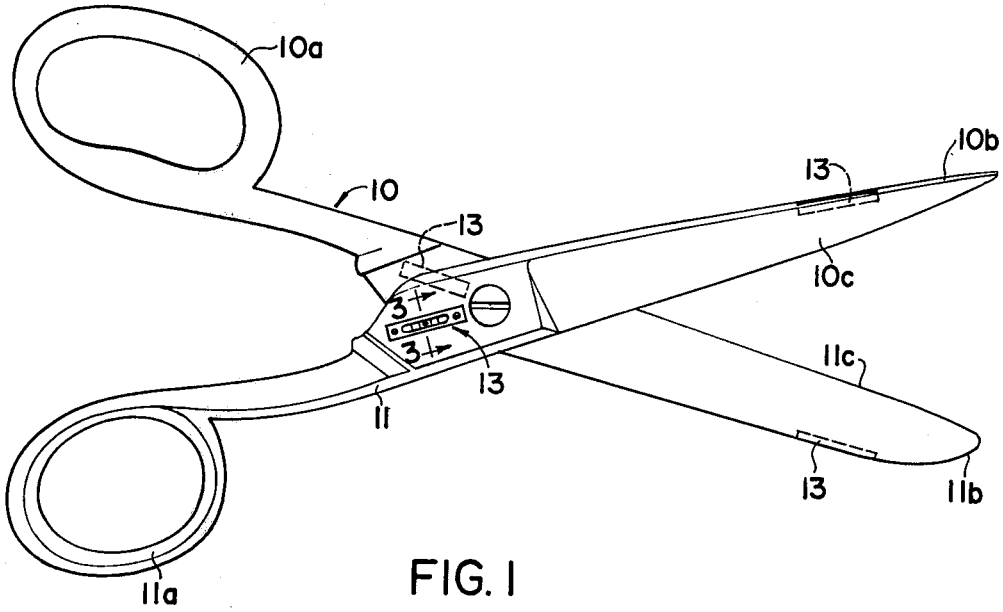
FIG. 1 is a top plan view of the hair shears of this invention with the shear blades in open position.
Figure 2:
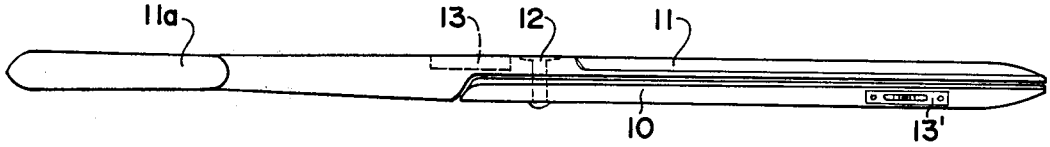
FIG. 2 is a side elevational view of the same with the shear blades closed.

AS seen in FIGS. 1 and 2, the hair cutting shears of this invention include two blade members 10 and 11, each having a hand-hold 10*a*, 11*a* at one end, and having a pointed cut end 10*b*, 11*b*. In the usual manner a pivot connection 12 between the two blade members is provided intermediate their ends securing them in oscillatable cutting relationship. Each of the blade members has, on its inner side, outwardly from the pivot connection 12, a longitudinally extending linear cutting edge 10*c*, 11*c* extending to the cutting end 10*b*, 11*b*.

Figure 3:
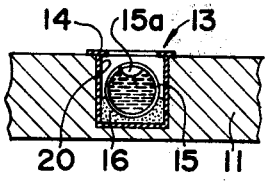
Figure 4:
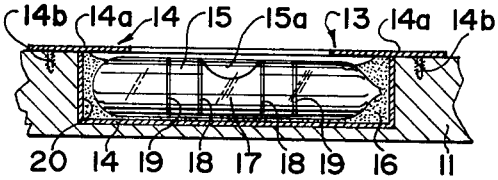
FIG. 4 is a side elevational view of the spirit level of FIG. 3 to the same scale.

Means is provided, rigidly mounted on the shears, to indicate the angle at which a cut is being made, relative to the horizontal. The means here shown is four spirit levels. As seen in FIGS. 3 and 4, the spirit level 13 consists of a small housing 14 in which is fixed a level-tube 15, held in fixed place by putty or plastic 16, or any other suitable means. The tube 15 is fluid-tight and filled usually with alcohol or ether with a small bubble of air 15*a* trapped inside the tube. The tube 15 has a plurality of markings spaced longitudinally along the same and will usually include a central mark 17 where the bubble will indicate and exact horizontal position, or two marks 18, spaced equally on opposite sides of the center to indicate the horizontal position when the bubble 15*a* is exactly spaced between them. In this invention, preferably other marks 19 are provided by which the hair stylist may determine the angle of a cut from the position of the bubble.

In this embodiment, the spirit levels are fixed in the blade members by provided recesses 20 into which the housing 14 fits, and the housing has ears 14*a* which are fastened to the blade members by screws 14*b*.

It will be noted that each of the spirit levels has its tube 15 extending longitudinally of its associated blade member. Two of the spirit levels are positioned, one on the outer face of each blade member adjacent the pivot connection 12 on the hand-hold side thereof. These will indicate the angle when the stylist is cutting in a generally horizontal plane. The other two spirit levels are positioned, one on the other edge of each blade member near its pointed cutting end as seen at 13' in FIG. 2. In this position these spirit levels are clearly visible when looking in the plane of the blade member from the outside inwardly.

The recesses 20 are of such depth, perferably that each spirit level is supported with its upper face on the level with the adjacent part of the blade member.

What is claimed is:

1. Hair cutting shears, comprising two generally linear blade members, each having a hand-hold end and a pointed cutting end, a pivot connection between said blade members intermediate their ends securing them in parallel oscillatable cutting relationship, each of said blade members having on its inner side a longitudinally extending linear cutting edge extending from said pivot connection to said pointed cutting end, four spirit levels rigidly secured to said blade members, one spirit level on the outer face of each blade member adjacent said pivot connection on the hand-hold side thereof, and one spirit level on the outer edge of each blade member near its pointed cutting end and visible in the plane of said blade member from the outside, all of said spirit levels extending longitudinally of the associated blade member.

2. Hair cutting shears as defined in claim 1, wherein said spirit levels have a plurality of equally spaced markings arranged along each said level, whereby a hair stylist using said shears, may make a cut at a predetermined level.

3. Hair cutting shears as defined in claim 1, wherein recesses are provided in said blade members, one for each of said spirit levels, said recesses of a depth to support each spirit level approximately with its upper face on the level with the adjacent part of said blade members.

* * * * *